US008997620B2

(12) United States Patent
Brown

(10) Patent No.: US 8,997,620 B2
(45) Date of Patent: Apr. 7, 2015

(54) HANDLE ASSEMBLY FOR CHARGING A DIRECT GAS IMPINGEMENT FIREARM

(71) Applicant: Michael J. Brown, Baltimore, MD (US)

(72) Inventor: Michael J. Brown, Baltimore, MD (US)

(73) Assignee: Adcor Industries, Inc., Baltimore, MD (US)

( * ) Notice: Subject to any disclaimer, the term of this patent is extended or adjusted under 35 U.S.C. 154(b) by 0 days.

(21) Appl. No.: 13/793,585

(22) Filed: Mar. 11, 2013

(65) Prior Publication Data

US 2014/0060294 A1 Mar. 6, 2014

Related U.S. Application Data

(60) Provisional application No. 61/634,988, filed on Mar. 9, 2012.

(51) Int. Cl.

| | |
|---|---|
| ***F41A 3/72*** | (2006.01) |
| ***F41A 7/00*** | (2006.01) |
| ***F41A 5/24*** | (2006.01) |
| ***F41A 7/02*** | (2006.01) |

(52) U.S. Cl.
CPC ... *F41A 7/00* (2013.01); *F41A 5/24* (2013.01); *F41A 7/02* (2013.01)

(58) Field of Classification Search
CPC ..... F41A 3/72; F41A 35/06; F41A 19/34; F41A 7/00; F41A 19/47
USPC ..... 89/1.4, 1.42, 179, 191.01, 191.02, 192, 89/187.01, 199; 42/14, 16, 69.02, 87
See application file for complete search history.

(56) References Cited

U.S. PATENT DOCUMENTS

| | | | |
|---|---|---|---|
| 1,379,989 | A | 5/1921 | Johnson |
| 1,402,459 | A | 1/1922 | Swebilius |
| 1,846,993 | A | 2/1932 | Destree |
| 1,878,038 | A | 9/1932 | Frommer |
| 2,056,577 | A | 10/1936 | Kehne |
| 2,341,767 | A | 2/1944 | Gans |
| 2,454,885 | A | 11/1948 | Robinson, Jr. |
| 2,462,119 | A | 2/1949 | Moore |
| 2,685,754 | A | 8/1954 | Crittendon et al. |

(Continued)

OTHER PUBLICATIONS

Article entitled "The USA's M4 Carbine Controversy" dated Feb. 2, 2009; www.defenseindustrydaily.com/the-usas-m4-carbone-controversy-03289/.

(Continued)

*Primary Examiner* — Samir Abdosh
*Assistant Examiner* — John D Cooper
(74) *Attorney, Agent, or Firm* — Howard & Howard Attorneys PLLC

(57) ABSTRACT

A firearm includes a receiver. A bolt carrier is moveable relative to the receiver between a firing position and a rearward position. A hand guard is coupled to the receiver. A gas tube is disposed at least partially within and fixed relative to the hand guard. A handle assembly is at least partially disposed in the hand guard and is moveable between a forward position and a charging position. The handle assembly has a body and an elongated member extending from the body toward the bolt carrier. The elongated member is disposed about the gas tube and is movable relative to the gas tube between the forward and charging positions. The elongated member engages the bolt carrier to move the bolt carrier from the firing position to the rearward position when the handle assembly moves from the forward position to the charging position.

21 Claims, 9 Drawing Sheets

(56) References Cited

U.S. PATENT DOCUMENTS

| | | | | |
|---|---|---|---|---|
| 2,752,826 | A | 7/1956 | Simpson | |
| 2,775,166 | A | 12/1956 | Janson | |
| 2,780,145 | A | 2/1957 | Save | |
| 2,783,685 | A | 3/1957 | Green | |
| 2,882,635 | A | 4/1959 | Hill | |
| 2,951,424 | A | 9/1960 | Stoner | |
| 3,176,424 | A | 4/1965 | Hoge | |
| 3,198,076 | A | 8/1965 | Stoner | |
| 3,225,653 | A | 12/1965 | Packard | |
| 3,236,155 | A | 2/1966 | Sturtevant | |
| 3,255,667 | A | 6/1966 | Walther | |
| 3,300,889 | A | 1/1967 | Baker | |
| 3,323,418 | A * | 6/1967 | Loffler | 89/193 |
| 3,368,298 | A | 2/1968 | Browning | |
| 3,397,473 | A | 8/1968 | Browning | |
| 3,405,470 | A | 10/1968 | Wesemann | |
| 3,592,101 | A | 7/1971 | Vartanian et al. | |
| 3,618,457 | A | 11/1971 | Miller | |
| 3,619,926 | A | 11/1971 | Alday | |
| 3,675,534 | A | 7/1972 | Beretta | |
| 3,686,998 | A * | 8/1972 | Seifried | 89/1.4 |
| 3,742,636 | A | 7/1973 | Dealy et al. | |
| 3,771,415 | A | 11/1973 | Into et al. | |
| 3,774,498 | A * | 11/1973 | Moller et al. | 89/1.4 |
| 3,776,095 | A | 12/1973 | Atchisson | |
| 3,938,271 | A | 2/1976 | Hyytinen | |
| 3,938,422 | A | 2/1976 | Tellie | |
| 3,960,053 | A | 6/1976 | Conley | |
| 3,969,980 | A | 7/1976 | Brandstatter et al. | |
| 3,999,461 | A | 12/1976 | Johnson et al. | |
| 4,020,741 | A | 5/1977 | Junker | |
| 4,044,487 | A | 8/1977 | Hutton et al. | |
| 4,088,057 | A | 5/1978 | Nasypany | |
| 4,125,054 | A | 11/1978 | Jennie | |
| 4,244,273 | A | 1/1981 | Langendorfer, Jr. et al. | |
| 4,246,830 | A | 1/1981 | Krieger | |
| 4,358,986 | A | 11/1982 | Giorgio | |
| 4,389,920 | A | 6/1983 | Dufour, Sr. | |
| 4,398,448 | A | 8/1983 | LaFever | |
| 4,416,186 | A | 11/1983 | Sullivan | |
| 4,475,437 | A | 10/1984 | Sullivan | |
| 4,505,182 | A | 3/1985 | Sullivan | |
| 4,553,469 | A | 11/1985 | Atchisson | |
| 4,565,113 | A | 1/1986 | Bunning | |
| 4,635,530 | A | 1/1987 | Weldle | |
| 4,654,993 | A | 4/1987 | Atchisson | |
| 4,663,875 | A | 5/1987 | Tatro | |
| 4,689,911 | A | 9/1987 | White | |
| 4,693,170 | A | 9/1987 | Atchisson | |
| 4,703,826 | A | 11/1987 | Byron | |
| 4,756,228 | A | 7/1988 | Rath | |
| 4,765,224 | A | 8/1988 | Morris | |
| 4,766,800 | A | 8/1988 | Miller et al. | |
| 4,867,039 | A | 9/1989 | Dobbins | |
| 4,893,547 | A | 1/1990 | Atchisson | |
| 4,930,399 | A * | 6/1990 | Trevor, Jr. | 89/191.02 |
| 4,972,617 | A | 11/1990 | Major | |
| 5,198,600 | A | 3/1993 | E'Nama | |
| 5,343,650 | A | 9/1994 | Swan | |
| 5,351,598 | A | 10/1994 | Schuetz | |
| 5,540,008 | A | 7/1996 | Kirnstatter | |
| 5,821,445 | A | 10/1998 | Guhring | |
| 5,824,923 | A | 10/1998 | Kondoh et al. | |
| 5,824,943 | A | 10/1998 | Guhring et al. | |
| 5,827,992 | A | 10/1998 | Harris et al. | |
| 5,918,401 | A | 7/1999 | Rowlands | |
| 5,945,626 | A | 8/1999 | Robbins | |
| 6,019,024 | A | 2/2000 | Robinson et al. | |
| 6,134,823 | A | 10/2000 | Griffin | |
| 6,257,114 | B1 | 7/2001 | Murello | |
| 6,311,603 | B1 | 11/2001 | Dunlap | |
| 6,418,655 | B1 | 7/2002 | Kay | |
| 6,453,594 | B1 | 9/2002 | Griffin | |
| 6,481,145 | B2 | 11/2002 | Weichert et al. | |
| 6,499,246 | B1 | 12/2002 | Zedrosser | |
| 6,508,158 | B2 | 1/2003 | Murello | |
| 6,564,491 | B2 | 5/2003 | Murello | |
| 6,609,321 | B2 | 8/2003 | Faifer | |
| 6,619,592 | B2 | 9/2003 | Vignaroli et al. | |
| 6,625,916 | B1 | 9/2003 | Dionne | |
| 6,634,274 | B1 | 10/2003 | Herring | |
| 6,722,255 | B2 | 4/2004 | Herring | |
| 6,732,466 | B2 | 5/2004 | Bentley | |
| 6,782,791 | B2 | 8/2004 | Moore | |
| 6,829,858 | B2 | 12/2004 | Gablowski | |
| 6,848,351 | B1 | 2/2005 | Davies | |
| 7,000,345 | B1 | 2/2006 | Kay | |
| 7,131,228 | B2 | 11/2006 | Hochstrate et al. | |
| 7,137,219 | B2 | 11/2006 | Wossner et al. | |
| RE39,465 | E | 1/2007 | Swan | |
| 7,219,463 | B2 | 5/2007 | Wossner | |
| 7,231,861 | B1 * | 6/2007 | Gauny et al. | 89/1.4 |
| 7,240,600 | B1 | 7/2007 | Bordson | |
| 7,347,023 | B2 | 3/2008 | Wossner et al. | |
| 7,418,898 | B1 | 9/2008 | Desomma | |
| 7,448,307 | B1 | 11/2008 | Dafinov | |
| 7,461,581 | B2 | 12/2008 | Leitner-Wise | |
| 7,469,624 | B1 | 12/2008 | Adams | |
| 7,478,495 | B1 | 1/2009 | Alzamora et al. | |
| 7,621,210 | B2 | 11/2009 | Fluhr et al. | |
| 7,637,199 | B2 | 12/2009 | Fluhr et al. | |
| 7,644,528 | B2 | 1/2010 | Wossner et al. | |
| 7,779,743 | B2 | 8/2010 | Herring | |
| 7,798,045 | B1 * | 9/2010 | Fitzpatrick et al. | 89/1.4 |
| 7,832,322 | B1 | 11/2010 | Hoel | |
| 7,832,326 | B1 | 11/2010 | Barrett | |
| 7,849,777 | B1 | 12/2010 | Zedrosser | |
| 7,891,284 | B1 | 2/2011 | Barrett | |
| 8,109,193 | B2 | 2/2012 | Herring | |
| 8,156,854 | B2 | 4/2012 | Brown | |
| 8,210,089 | B2 | 7/2012 | Brown | |
| 2003/0074822 | A1 | 4/2003 | Faifer | |
| 2005/0115134 | A1 | 6/2005 | Bond et al. | |
| 2005/0115398 | A1 | 6/2005 | Olson | |
| 2005/0262752 | A1 | 12/2005 | Robinson et al. | |
| 2006/0065112 | A1 | 3/2006 | Kuczynko et al. | |
| 2006/0156606 | A1 | 7/2006 | Robinson et al. | |
| 2006/0236582 | A1 | 10/2006 | Lewis et al. | |
| 2006/0254112 | A1 | 11/2006 | Snoderly | |
| 2007/0033851 | A1 | 2/2007 | Hochstrate et al. | |
| 2007/0199435 | A1 | 8/2007 | Hochstrate et al. | |
| 2008/0110074 | A1 | 5/2008 | Bucholtz et al. | |
| 2009/0000173 | A1 | 1/2009 | Robinson et al. | |
| 2009/0007477 | A1 | 1/2009 | Robinson et al. | |
| 2009/0031605 | A1 | 2/2009 | Robinson | |
| 2009/0031606 | A1 | 2/2009 | Robinson et al. | |
| 2009/0031607 | A1 | 2/2009 | Robinson et al. | |
| 2009/0064556 | A1 | 3/2009 | Fluhr et al. | |
| 2009/0120277 | A1 | 5/2009 | Adams | |
| 2011/0271827 | A1 * | 11/2011 | Larson et al. | 89/193 |

OTHER PUBLICATIONS

Article entitled "M4 Carbine Review"dated May 4, 2007; http//home.comcast.net/shooter2_indy/m4.html.

Article entitled "Critics Turn Crosshairs on Military's Main Rifle" dated Apr. 20, 2008 from the website "USA TODAY"; www.usatoday.com/news/military/2008-04-20-gunwars_N.htm.

Parts Schematic entitled "Schematic for Bushmaster M4A3 Carbine" from the website "Bushmaster" dated Jun. 2008; www.bushmaster.com/electronic-documents/operation-manual/opmanual.pdf.

Article entitled "M26 Modular Accessory Shotgun Systems Photos and Video" from the website "The Firearm Blog" dated Nov. 2, 2007; www.thefirearmblog.com/blog/2007/11/02/m26-modular-accessory-shotgun-system-photos-and-video/.

Catalog item LMT: Standard MRP (rifle) version from the website "Lewis Machine Tool Company" dated Jun. 2008; www.lewismachine.net/product.php?p=56&cid=8&session=85945e8b595ef2d461b8980961cf870a.

(56) References Cited

OTHER PUBLICATIONS

Article entitled "M16 rifle" from Wikipedia, the free encyclopedia dated Jun. 2008; http://en.wikipedia.org/wiki/M-16_rifle.
Article entitled "M4 Carbine" from Wikipedia, the free encyclopedia dated Jun. 2008; http://en.wikipedia.org/wiki/M4_carbine.
Animation entitled "How an AR15 Works" from the website dated Jun. 2008; www.barnesengineering.com/AR15animation/index.htm.
Article entitled "M26 Modular Accessory Shotgun System" from Wikipedia, the free encyclopedia dated Jul. 2009; http://en.wiki/M26_Modular_Accessory_Shotgun_System.

* cited by examiner

HANDLE ASSEMBLY FOR CHARGING A DIRECT GAS IMPINGEMENT FIREARM

RELATED APPLICATION

This application claims priority to and all advantages of U.S. Provisional Patent Application No. 61/634,988, which was filed on Mar. 9, 2012.

BACKGROUND OF THE INVENTION

1. Field of the Invention

The subject invention relates to firearms utilizing a direct gas impingement system. In particular, the subject invention relates to a device for moving a bolt carrier of the firearm from a forward position to charging position.

2. Description of Related Art

Firearms typically include a receiver that houses several working components of the firearm, including firing components, with a barrel extending from the receiver. There are various classes of firearms that operate in different manners. One class of firearm utilizes a bolt carrier disposed in the receiver that is moveable between a firing position, from which a live round of ammunition can be fired, and a retracted position, from which a spent casing is ejected. The movement of the bolt carrier and ejection of the casing can be accomplished with a direct gas impingement system. Examples of gas impingement type firearms include the M16, the M4®, such as the M4® carbine, and the AR-15®, such as the AR-15® Platform.

Firearms having the direct gas impingement system typically include an ejection port defined by the receiver. Direct gas impingement systems route exhaust gases back through the firearm to move the bolt carrier toward the retracted position. In particular, after firing the firearm, the direct gas impingement system routes exhaust gases from the barrel, back through a return tube to the bolt carrier, and out the ejection port of the receiver.

Firearms having the direct gas impingement system require an initial manual movement of the bolt carrier from the firing position toward the retracted position to initially load a live round into the firearm. In order to accomplish this manual movement, a device known as a charging handle is provided at the rear of the receiver near the buttstock. A user must lower the firearm and manually grasp the charging handle and pull the charging handle toward the buttstock. The charging handle engages the bolt carrier directly to retract the bolt carrier.

During operation, the bolt carrier automatically moves between the firing and retracted positions to eject a spent casing and to load a live round. In certain circumstances, the firearm can jam or fail with either the casing not being fully ejected or the round not being fully loaded into the firearm. In such situations, the charging handle can be utilized to fully eject the casing.

Although necessary, the lowering of the firearm during combat situations to perform these tasks is undesirable. Therefore, there remains an opportunity to develop a charging mechanism for a firearm utilizing a direct gas impingement system which can be used while maintaining the firearm in a ready position aimed at a target.

SUMMARY OF THE INVENTION AND ADVANTAGES

The subject invention provides for a firearm including a receiver defining a receiver bore extending along a longitudinal axis. A bolt carrier is disposed in the receiver bore and is moveable relative to the receiver along the longitudinal axis between a firing position and a rearward position. A hand guard is coupled to the receiver. A gas tube is disposed at least partially within and fixed relative to the hand guard and extends substantially parallel to the longitudinal axis. A handle assembly is at least partially disposed in the hand guard and is moveable between a forward position and a charging position. The handle assembly has a body and an elongated member extending from the body toward the bolt carrier substantially parallel to the longitudinal axis. The elongated member is disposed about the gas tube and is movable relative to the gas tube between the forward and charging positions. The elongated member engages the bolt carrier to move the bolt carrier from the firing position to the rearward position when the handle assembly moves from the forward position to the charging position.

The subject invention also includes a charging mechanism for a firearm. The charging mechanism includes a bolt carrier extending along a longitudinal axis. A gas tube extends substantially parallel to the longitudinal axis. The charging mechanism further includes a handle assembly having a body and an elongated member extending from the body toward the bolt carrier substantially parallel to the longitudinal axis. The elongated member is disposed about the gas tube and is movable relative to the gas tube between a forward position and a charging position. The elongated member engages and moves the bolt carrier from a firing position to a rearward position as the handle assembly moves from the forward position to the charging position.

The subject invention also includes a handle assembly for a charging mechanism of a firearm having a bolt carrier. The handle assembly includes a body including a base defining a body bore along a handle axis. An arm is coupled to the base and is configured to move the handle assembly from a forward position to a charging position. An elongated member extends along the handle axis and is at least partially disposed within and fixedly secured to the body bore. The elongated member engages and moves the bolt carrier from a firing position to a rearward position as the handle assembly moves from the forward position to the charging position.

Accordingly, the handle assembly is used to move the bolt carrier from the firing position toward the rearward position by moving the handle assembly from the forward position to the charging position. Such a configuration advantageously disposes the handle assembly in a position that does not require a user to lower the firearm. As such, during operation, the user can cycle the bolt carrier from the firing position to the rearward position for removing a cartridge without lowering the firearm.

BRIEF DESCRIPTION OF THE DRAWINGS

Advantages of the subject invention will be readily appreciated as the same becomes better understood by reference to the following detailed description when considered in connection with the accompanying drawings.

DETAILED DESCRIPTION OF THE INVENTION

Figure 1:
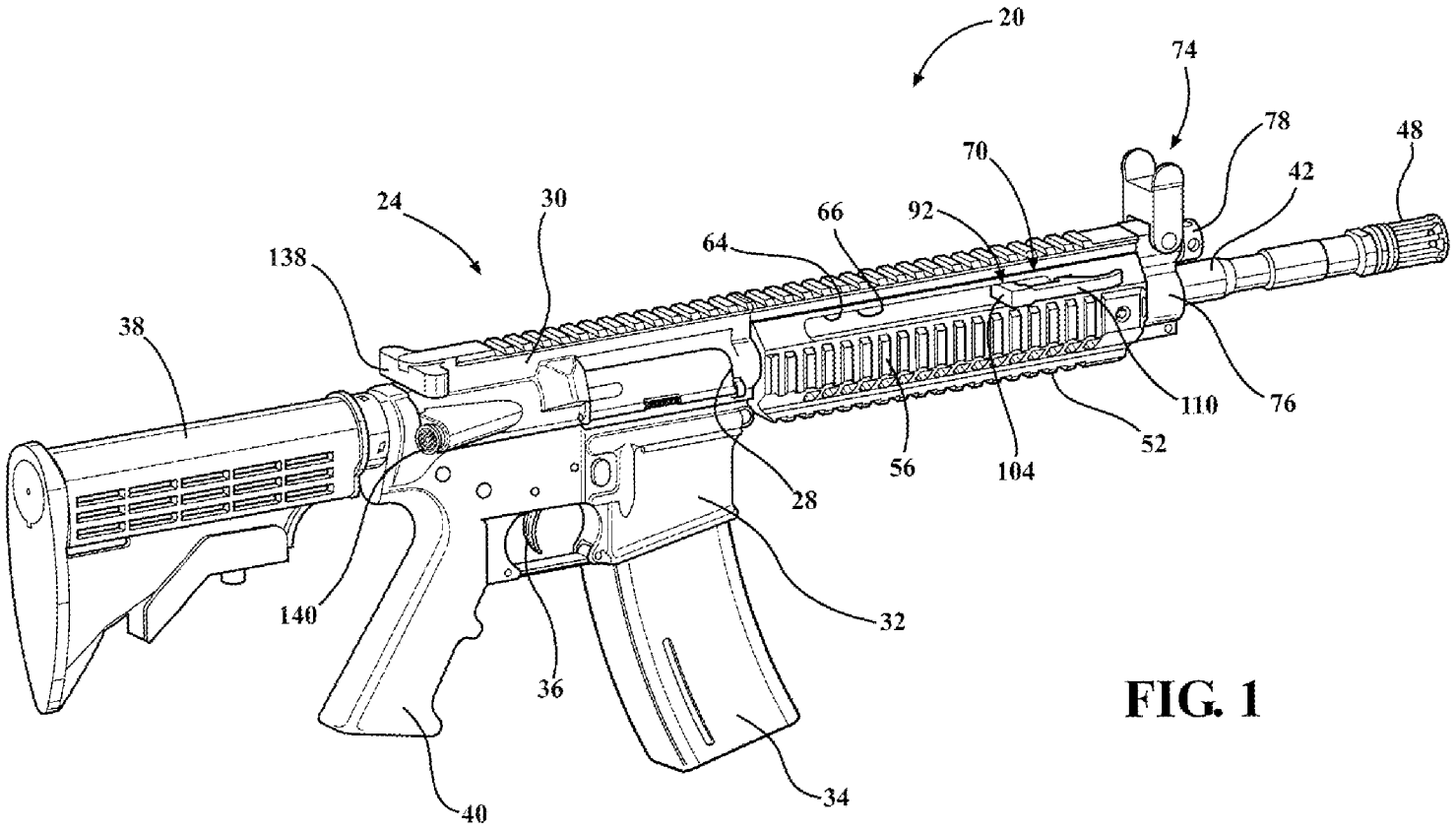
FIG. 1 is a perspective view of an embodiment of a firearm.
Figure 3:
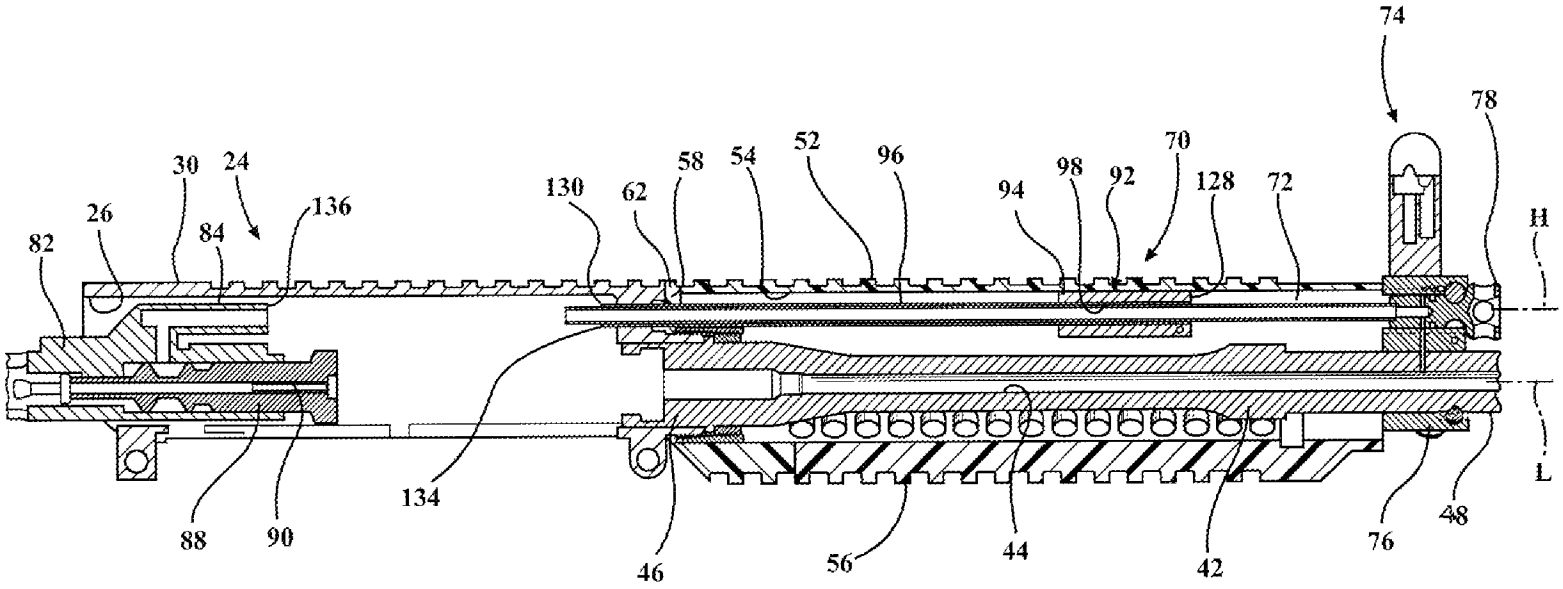
FIG. 3 is a cross-sectional view of the bolt carrier in a rearward position and a handle assembly of the firearm in a forward position.

Referring to the Figures, wherein like numerals indicate like or corresponding parts throughout the several views, a firearm 20 is generally shown in FIG. 1. The firearm 20 receives and fires a live round of ammunition 22 (as shown in FIG. 3), also referred to as a cartridge, which includes a casing, a bullet, and other components to propel the bullet as known to those skilled in the art Ammunition 22 that has been fired is referred to as a spent round of ammunition 22.

The firearm 20 utilizes a direct gas impingement system to eject a spent casing of the ammunition 22 after firing the firearm 20. Examples of such types of firearms 20 include the M16, the M4®, such as the M4® carbine, and the AR-15®, such as the AR-15® Platform. The firearm 20 described herein is designed to permit easy retro-fitting of the certain components to a variety of currently and/or previously manufactured firearm 20 designs having direct gas impingement systems.

Figure 2:
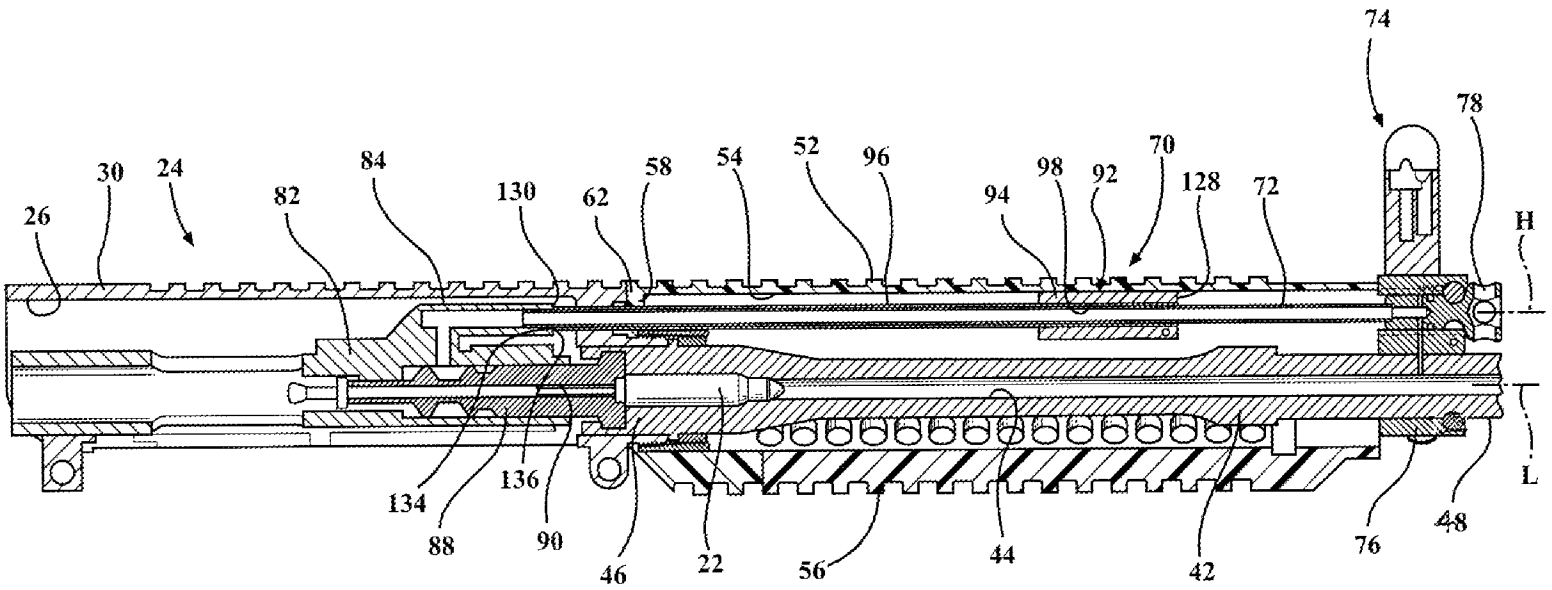
FIG. 2 is a cross-sectional view of a bolt carrier of the firearm in a firing position and a handle assembly of the firearm in a forward position.
Figure 5:
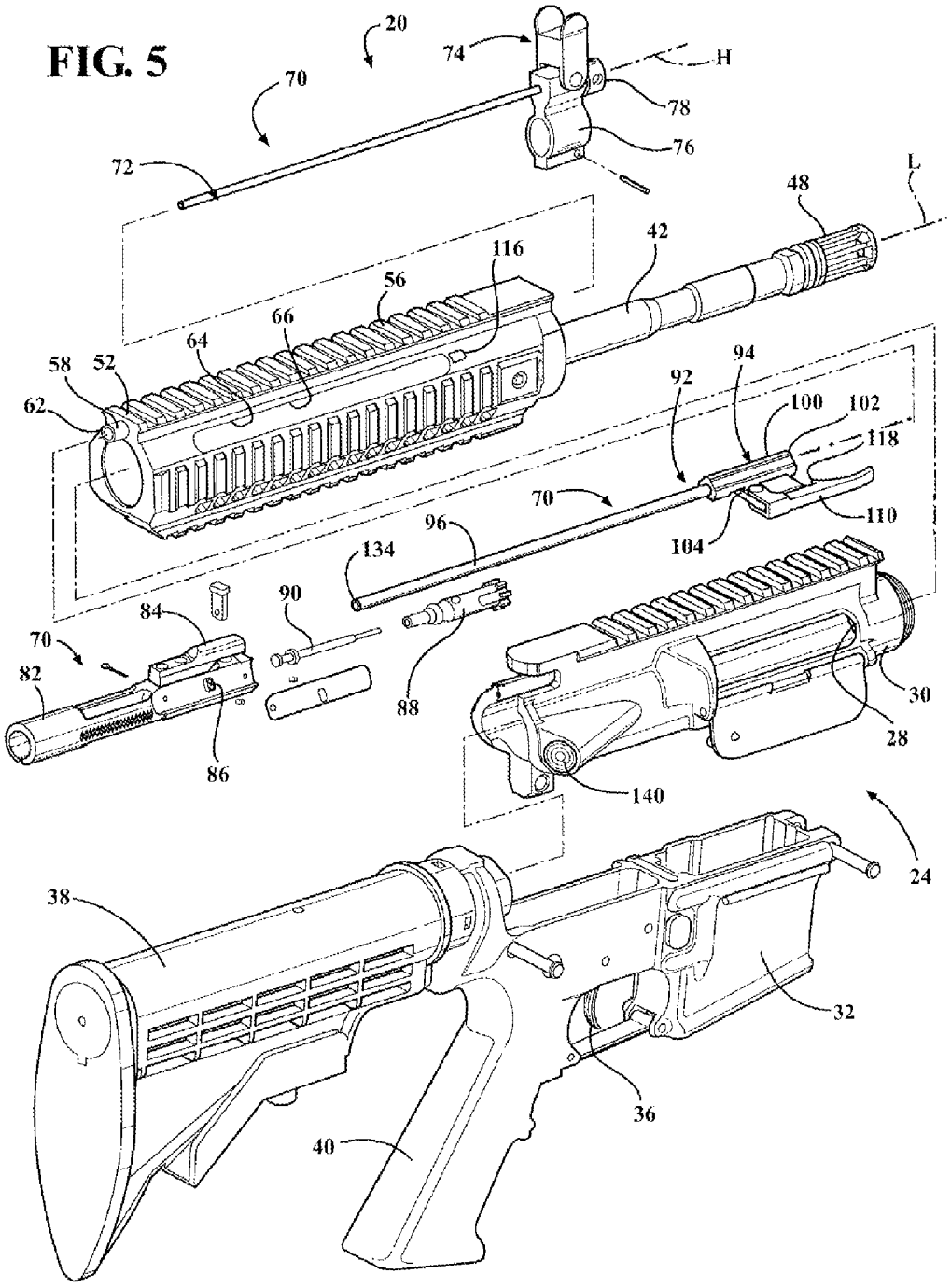
FIG. 5 is an exploded view of the firearm.

As shown in FIG. 2, the firearm 20 includes a receiver 24 defining a receiver bore 26 extending along a longitudinal axis L. The receiver 24 houses several working components of the firearm 20, such as the firing components, i.e. the action. As shown in FIG. 5, the receiver 24 defines an ejection port 28 transverse to the longitudinal axis L. As known in the art, the receiver 24 is often divided into an upper receiver portion 30 and a lower receiver portion 32 attached to the upper receiver portion 30. In this configuration, the upper receiver portion 30 defines the receiver bore 26 and the ejection port 28.

As shown in FIG. 1, a magazine 34, also referred to as a clip, is detachably mounted to the lower receiver portion 32 and can be loaded with a plurality of live rounds of ammunition 22. The firearm 20 further includes a trigger assembly supported by the receiver 24. The trigger assembly includes a trigger 36 and a hammer (not shown). The trigger 36 is pulled to move the hammer, which, as discussed further below, ultimately results in the firing of the firearm 20.

A buttstock 38 extends rearwardly from the receiver 24 for supporting the firearm 20 against a shoulder of a user. A hand grip 40 extends downwardly along the upper receiver portion 30 for grasping by the user.

Figure 4:
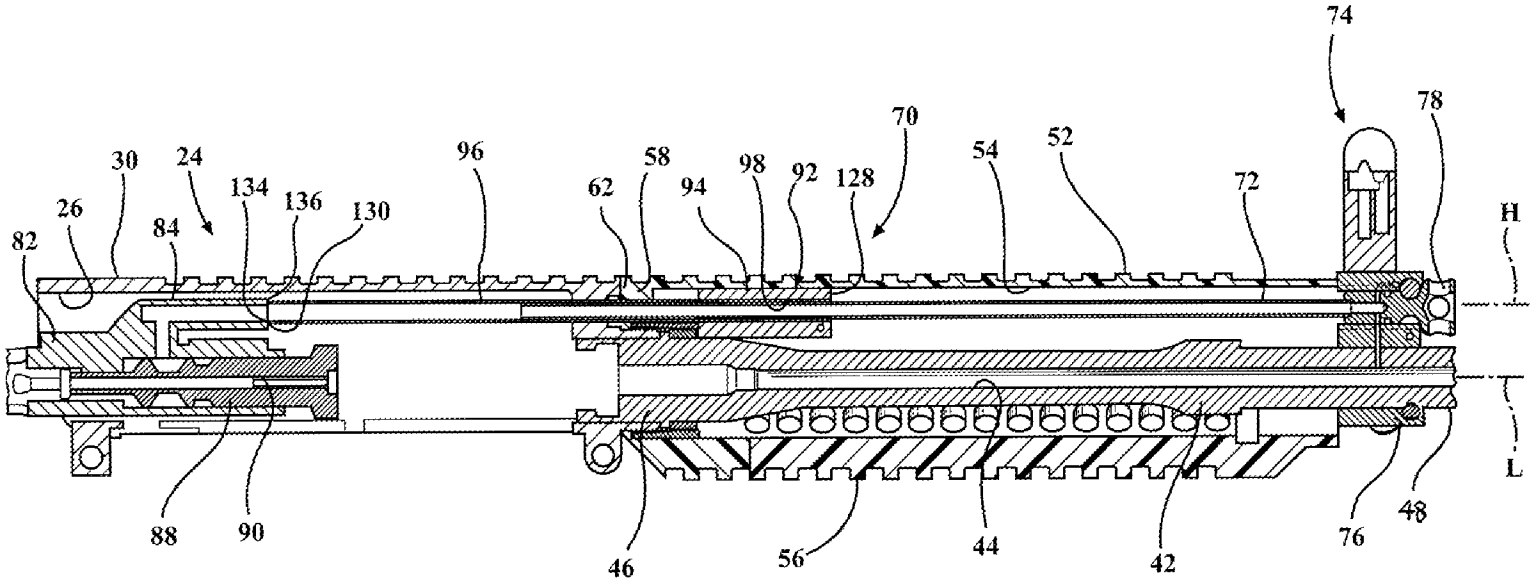
FIG. 4 is a cross-sectional view of the bolt carrier in a rearward position and the handle assembly of the firearm in a charging position.

A barrel 42 is coupled to the receiver 24 and defines a barrel bore 44 extending along the longitudinal axis L. The barrel 42 includes a breech 46 adjacent the receiver 24, as shown in FIGS. 2-4, and a muzzle 48 spaced from the breech 46 along the longitudinal axis L, as shown in FIGS. 1 and 5. As shown in FIG. 2, the breech 46 defines a chamber extending along the longitudinal axis L for receiving one of the live rounds of ammunition 22. The live rounds of ammunition 22 are individually loaded into the chamber from the magazine 34. The chamber aligns with the barrel bore 44 such that the bullet moves out of the chamber and the barrel bore 44 when firing the firearm 20. The barrel 42 further defines a port proximate the muzzle 48 extending transverse to the chamber. The port is fluidly coupled to the chamber. The port will be better understood through further discussion below.

The firearm 20 includes a hand guard 52 coupled to the receiver 24. The hand guard 52 extends along the longitudinal axis L about the barrel 42. However, it is appreciated that the hand guard 52 and the barrel 42 can be of any type without departing from the nature of the subject invention.

Figure 6:
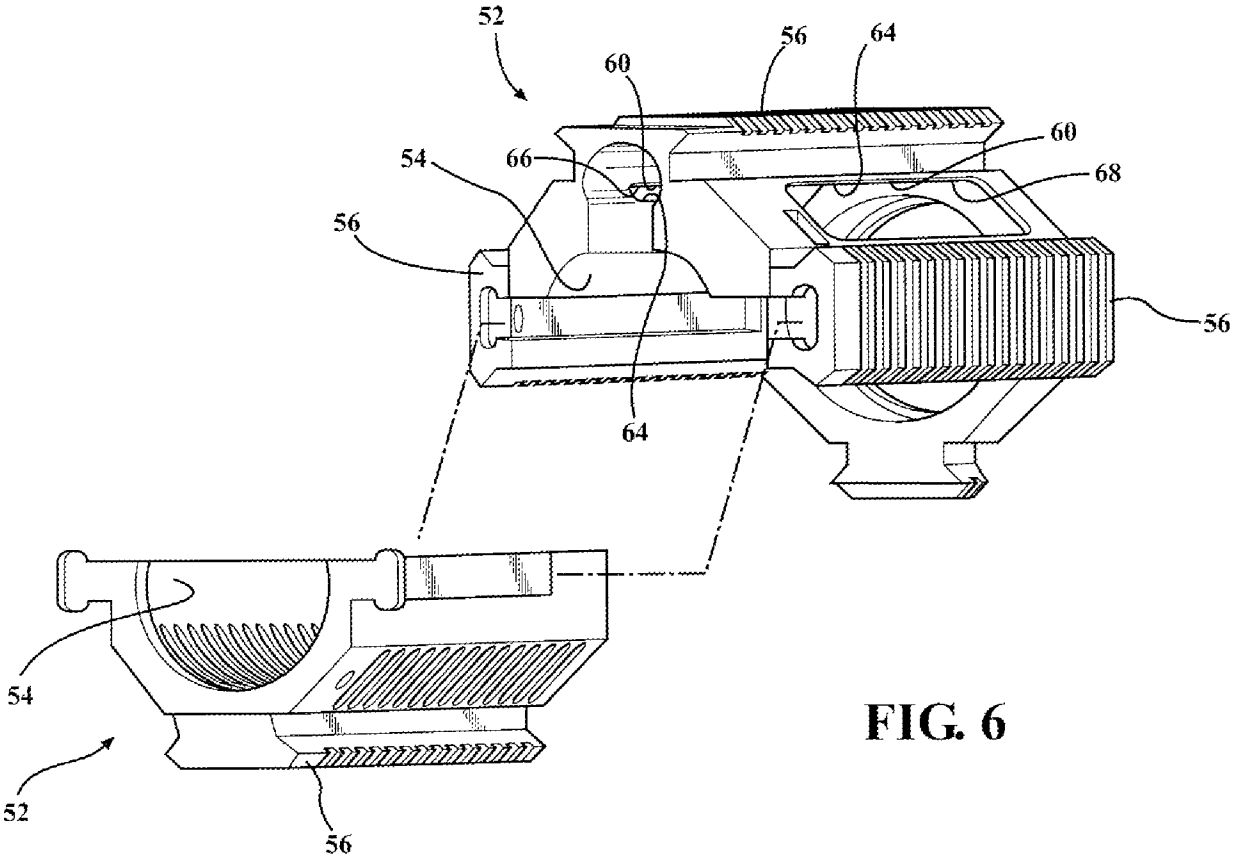
FIG. 6 is an exploded view of a hand guard of the firearm.
Figure 7:
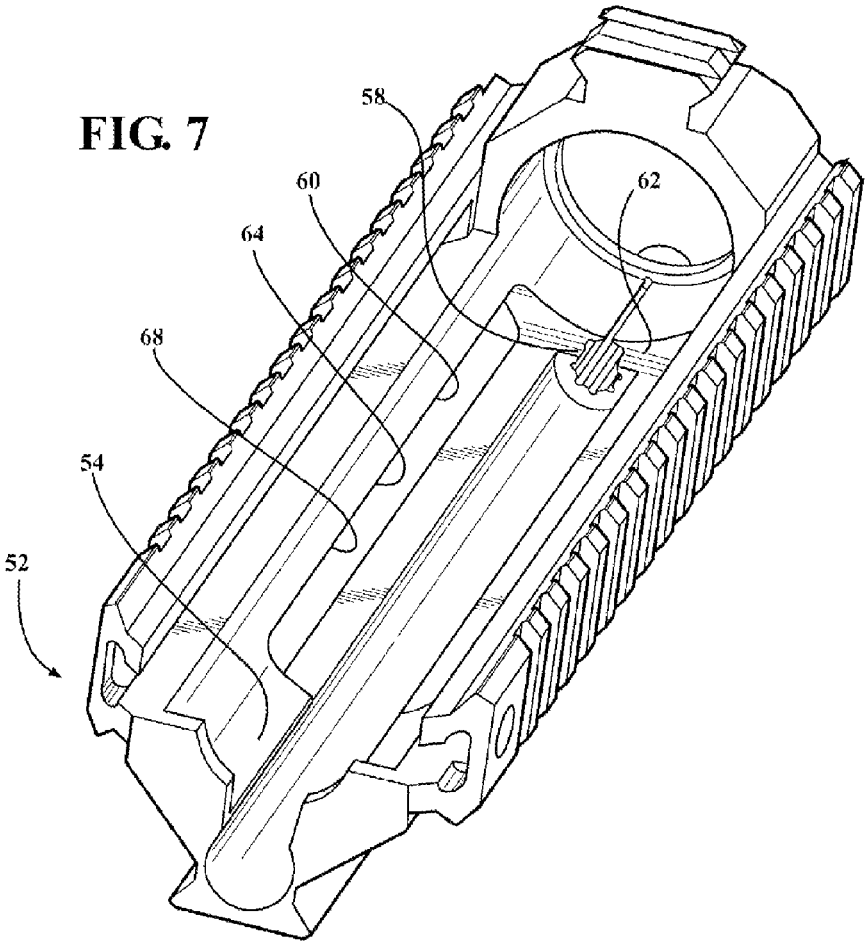
FIG. 7 is an interior perspective view of a portion of the hand guard.

The hand guard 52 defines a hand guard bore 54 extending substantially parallel to the longitudinal axis L. The barrel 42 extends from the receiver 24 through the hand guard bore 54. The hand guard 52 protects the user's hand from heat generated by the firing of the firearm 20. As shown in FIGS. 6 and 7, the hand guard 52 can include a series of connection points that are known in the industry as a rail system 56 for mounting additional components to the hand guard 52. For example, such components can include bipods, tripods, scopes, bayonets, lasers, shot guns, grenade launchers, etc.

The hand guard 52 defines a first support 58, as shown in FIG. 7, and a second support 60, as shown in FIG. 6. More specifically, the first support 58 is further defined as a bushing 62 extending substantially parallel to the longitudinal axis L for locating the hand guard 52 relative to the receiver 24. Specifically, the bushing 62 extends into the receiver 24. It is to be appreciated that the hand guard 52 can be attached to the receiver 24 in any fashion without departing from the nature of the subject invention. As shown in FIG. 7, the bushing 62 has a splined configuration to accommodate for thermal expansion due to heat generated by operation of the firearm 20 and to accommodate for dirt in the hand guard bore 54. As generally shown in FIG. 6, the second support 60 is further defined as a slot 64 extending substantially parallel to the longitudinal axis L. More specifically, the second support 60 is further defined as a first slot 66 and a second slot 68 spaced from each other about the longitudinal axis L. The first and second supports 58, 60 will be better understood through further discussion below.

As shown in FIGS. 2-4, the firearm 20 includes a charging mechanism 70 disposed within and extending between the receiver 24 and the hand guard 52. The charging mechanism 70 will be better understood through further discussion below.

The firearm 20 includes a gas tube 72 disposed at least partially within and fixed relative to the hand guard 52 and extending substantially parallel to the longitudinal axis L. More specifically, the charging mechanism 70 includes the gas tube 72 extending substantially parallel to the longitudinal axis L. The gas tube 72 extends from the hand guard 52 proximate the muzzle 48 of the barrel 42 through the bushing 62 and into the receiver 24.

The firearm 20 further includes a sight assembly 74 proximate the muzzle 48 of the barrel 42. More specifically, the charging mechanism 70 includes the sight assembly 74. The sight assembly 74 includes a gas block 76 and a regulator 78. The gas block 76 is attached to the barrel 42 over the port. The gas block 76 includes a port tube 80 fluidly coupling the port to the regulator 78. The regulator 78 is further fluidly coupled to the gas tube 72. The port, port tube 80, regulator 78, and gas tube 72 route exhaust gas away from the barrel 42 after firing the live round of ammunition 22. It is appreciated that the port can be in communication with the gas tube 72 in any suitable fashion without departing from the nature of the subject invention. Furthermore, the sight assembly 74 can be mounted to the barrel 42 by a roll-pin and set screw as is typically performed in the industry (and as generally shown in FIGS. 2-4), or by any other suitable means.

The regulator 78 is in communication with the gas tube 72 to regulate the pressure in the gas tube 72 after firing the ammunition 22. A cyclic rate, i.e., the speed at which the spent ammunition 22 is ejected and another live round of ammunition 22 is loaded, is adjusted by rotating the regulator 78.

The firearm 20 includes a bolt carrier 82 disposed in the receiver bore 26. More specifically, the charging mechanism 70 includes the bolt carrier 82. The bolt carrier 82 is moveable relative to the receiver 24 along the longitudinal axis L between a firing position and a rearward position. In the firing position, as shown in FIG. 2, the bolt carrier 82 is disposed adjacent the breech 46 of the barrel 42. In the rearward position, as shown in FIGS. 3 and 4, the bolt carrier 82 is spaced from the breech 46 of the barrel 42.

The bolt carrier 82 has a key 84 extending toward a handle assembly 92. As shown in FIG. 2, the gas tube 72 is at least partially disposed within the key 84 when the bolt carrier 82 is in the firing position. The gas tube 72 fluidly coupled to the key 84 in the firing position. As shown in FIGS. 3 and 4, the gas tube 72 is spaced from the key 84 when the bolt carrier 82 is in the rearward position. More specifically, the key 84 defines a cavity. As shown in FIG. 2, the cavity is configured to accept the gas tube 72 when bolt carrier 82 is in the firing position. The cavity typically has a cylindrical configuration; however, it is to be appreciated that the cavity can have any suitable configuration.

As shown in FIG. 5, the bolt carrier 82 defines at least one exhaust port 86 extending transverse to the longitudinal axis L and fluidly coupled to the key 84. The firearm 20 further includes a shield longitudinally affixed to the bolt carrier 82 and moving with the bolt carrier 82 as a unit between the firing and rearward positions along the longitudinal axis L.

The firearm 20 further includes a bolt 88 and a firing pin 90 carried by the bolt carrier 82. The bolt carrier 82 typically has features for automatically releasing another live round of ammunition 22 from the magazine 34 into the chamber as the bolt carrier 82 moves toward the firing position. As the bolt carrier 82 moves from the rearward position toward the firing position, the bolt carrier 82 catches or pushes another live round of ammunition 22 into the chamber of the barrel 42. In the firing position, the bolt 88 locks to the breech 46 of the barrel 42 to hold the live round of ammunition 22 in the chamber.

As generally shown in FIG. 2, when the bolt carrier 82 is in the firing position, the trigger 36 can be pulled to release the hammer, which strikes the firing pin 90. When the hammer strikes the firing pin 90, the firing pin 90 strikes the live round of ammunition 22 to fire the ammunition 22, which causes the bullet to move through and out of the barrel bore 44. After firing the live round of ammunition 22, the exhaust gases are routed back to the bolt carrier 82 through the gas tube 72, as described above. The exhaust gases enter the key 84 of the bolt carrier 82 and are then routed through the bolt carrier 82 and out the exhaust ports 86. The force of the exhaust gases pushes the bolt carrier 82 toward the rearward position, as shown in FIG. 3. During the movement of the bolt carrier 82, the key 84 separates from the gas tube 72. As the bolt carrier 82 moves toward the rearward position, the casing of the ammunition 22, which is now empty, is expelled from the receiver 24 through the ejection port 28. The routing of the exhaust gases is known as the direct gas impingement system. The bolt carrier 82 then automatically returns to the firing position and automatically loads another live round of ammunition 22 from the magazine 34 into the chamber.

As shown in FIGS. 2-4, the firearm 20 includes the handle assembly 92 at least partially disposed in the hand guard 52. More specifically, the charging mechanism 70 includes the handle assembly 92. The handle assembly 92 has a body 94 and an elongated member 96. The handle assembly 92 is moveable between a forward position, as shown in FIGS. 2 and 3, and a charging position, as shown in FIG. 4. More specifically, the handle assembly 92 translates linearly and substantially parallel to the longitudinal axis L. In the forward position, the handle assembly 92 is disposed toward the muzzle 48 of the barrel 42. In the charging position, the handle assembly 92 is disposed toward the breech 46 of the barrel 42.

Figure 8:
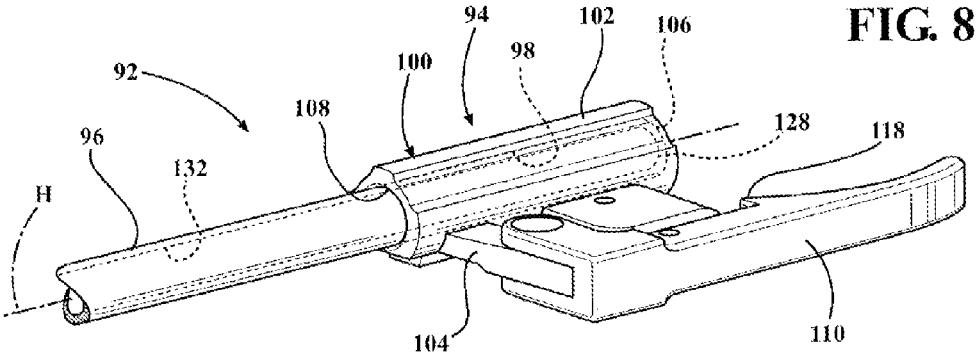
FIG. 8 is a perspective view of the handle assembly.

As shown in FIG. 2, the body 94 defines a body bore 98 substantially parallel to the longitudinal axis L. More specifically, the body 94 includes a base 100 which defines the body bore 98 along a handle axis H, as shown in FIG. 8. Even more specifically, the base 100 includes a sleeve 102 and a slider 104 fixed to one another with the sleeve 102 of the base 100 defining the body bore 98. The sleeve 102 further defines a first opening 106, shown in FIG. 9, and a second opening 108, shown in FIG. 8, opposite one another and co-linear with the body bore 98. The handle axis H is substantially parallel to the longitudinal axis L, as show in FIGS. 2-4. Moreover, the gas tube 72 also extends along the handle axis H.

Figure 10:
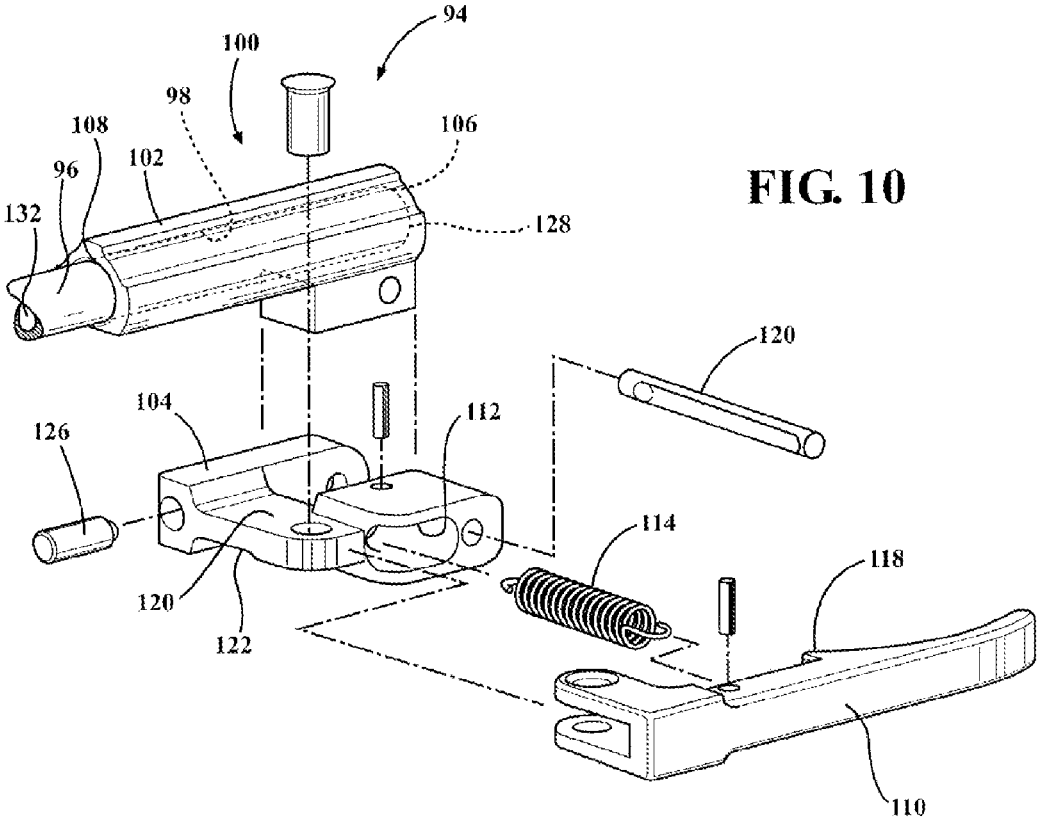
FIG. 10 is an exploded perspective view of the first embodiment of the handle assembly.

The slider 104 and the sleeve 102 are separately formed and subsequently fixed to one another together, as best illustrated in FIG. 10. However, the slider 104 and the sleeve 102 can be integral, i.e., formed of a single piece of material. Furthermore, it is to be appreciated that the slider 104 and the sleeve 102 can be connected together in any fashion, such as welding, bolting, pinning, etc., without departing from the nature of the subject invention.

As shown in FIG. 2-4, the body 94 of the handle assembly 92 is disposed in the hand guard bore 54 and has a complimentary configuration to the hand guard bore 54 such that the body 94 can slide along the hand guard bore 54.

Figure 11:
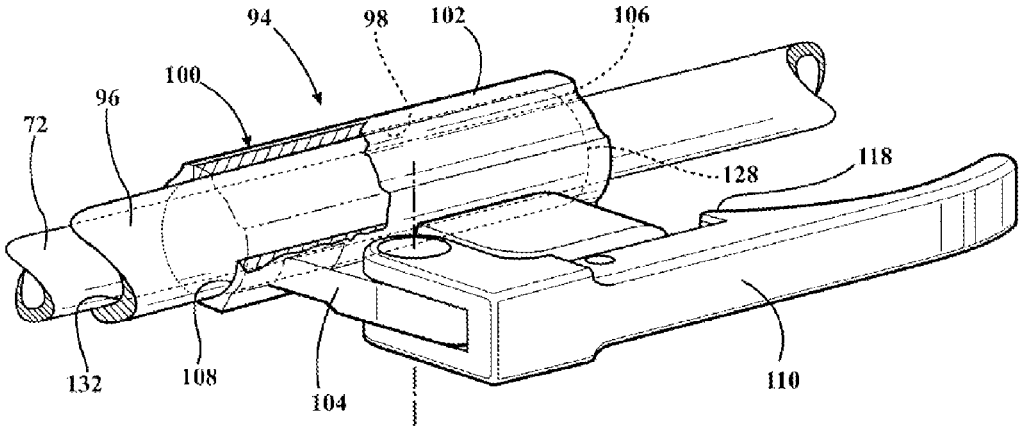
FIG. 11 is a partially cross-sectional perspective view of the handle assembly having body including an arm, and a gas tube of the firearm with the arm in a disengaged position.
Figure 12:
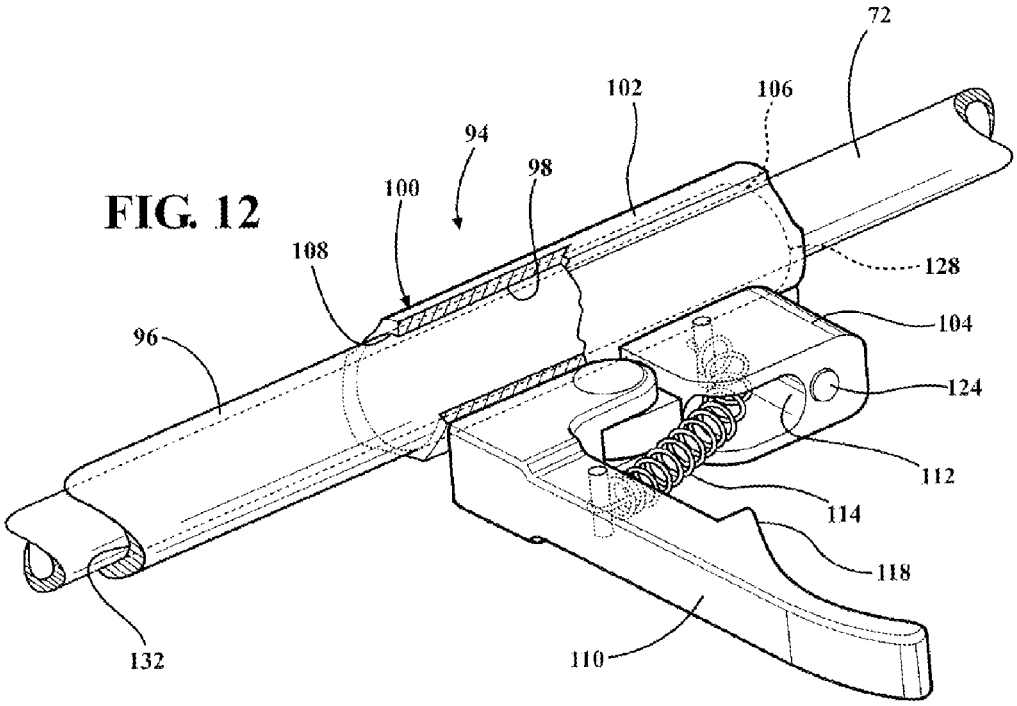
FIG. 12 is a partially cross-sectional perspective view of the handle assembly and the gas tube with the arm in an engaged position.

As shown in FIGS. 8-12, the body 94 includes an arm 110 coupled to the base 100 and configured to move the handle assembly 92 from the forward position to the charging position. The arm 110 is pivotable relative to the base 100 between an engaged position, as shown in FIG. 12, and a disengaged position, as shown in FIG. 11, with the arm 110 configured to move the handle assembly 92 from the forward position to the charging position when the arm 110 is in the engaged position. More specifically, the arm 110 is coupled to the slider 104 of the base 100 and is selectively moveable relative to the slider 104 between the engaged position and disengaged position.

As generally shown in FIG. 1, the slider 104 extends into at least one of the first and second slots 66, 68 of the hand guard 52. As will be described in greater detail below, the arm 110 is coupled to the slider 104 and is partially disposed within one of the first and second slots 66, 68. At least a majority of the arm 110 is disposed outside of the hand guard 52. In the disengaged position the arm 110 is disposed substantially parallel to the handle axis H. In the engaged position the arm 110 is disposed transverse to the handle axis H.

The arm 110 is typically disposed in the disengaged position. Specifically, the slider 104 of the handle assembly 92 defines a pocket 112, as shown in FIGS. 10 and 12. The body 94 includes a spring 114 disposed in the pocket 112 and coupled to each of the slider 104 and the arm 110 for bias the arm 110 toward the disengaged position.

As shown in FIG. 5, the hand guard 52 defines a notch 116 and the arm 110 includes a projection 118 nesting with the notch 116 when the handle assembly 92 is in the forward position and the arm 110 is rotated to the disengaged position, as show in FIG. 1. The spring 114 releasably retains the projection 118 of the arm 110 in the notch 116 of the hand guard 52. Said differently, the user of the firearm 20 can pivot the arm 110 relative to the base 100 to remove the projection 118 from the notch 116. When the firearm 20 is fired, the nesting of the projection 118 in the notch 116 retains the handle assembly 92 in the forward position.

The handle assembly 92 is ambidextrous. In other words, the handle assembly 92 can extend from either side of the hand guard 52 depending upon which hand the user prefers to use to move the handle assembly 92 from the forward position to the charging position. Specifically, the slider 104 and the body 94 are selectively arranged in a first configuration with the handle assembly 92 extending from the hand guard 52 only through the first slot 66 and a second configuration with the handle assembly 92 extending from the hand guard 52 only through the second slot 68.

As shown in FIG. 10, the slider 104 includes a first slot surface 120 and a second slot surface 122 spaced from each other. The first slot surface 120 and the second slot surface 122 are mirror images of each other. The base 100 abuts the first slot surface 120 in the first configuration and the base 100 abuts the second slot surface 122 in the second configuration. In other words, in the first configuration, the base 100 abuts the first slot surface 120 such that the handle assembly 92 extends through the first slot 66 when assembled to the hand guard 52. In the second configuration, the slider 104 is flipped over relative to the base 100 so that the base 100 abuts the second slot surface 122 such that the handle assembly 92 extends through the second slot 68 when assembled to the hand guard 52.

Figure 9:
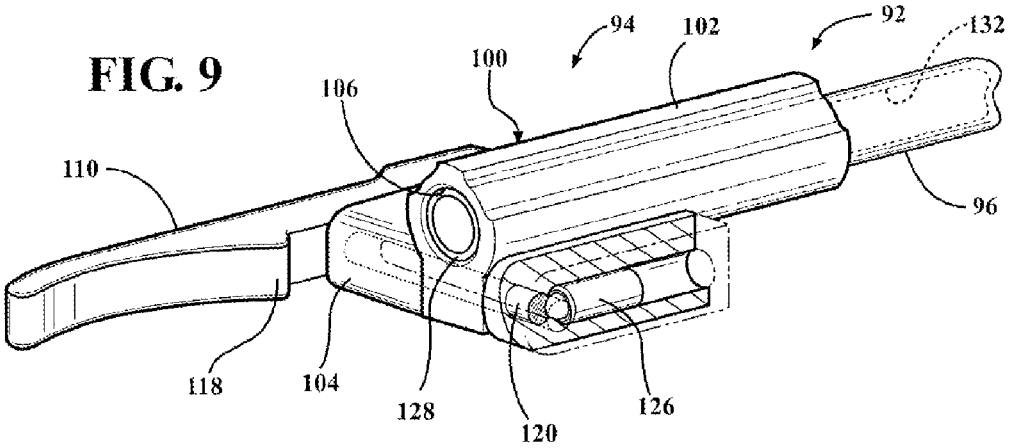
FIG. 9 is a partially cross-sectional perspective view of the handle assembly including a plunger engaged and an assembly pin.

As shown in FIGS. 9 and 10, an assembly pin 124 is supported by the slider 104 with the assembly pin 124 engaging with the sleeve 102. The assembly pin 124 extends through the slider 104 and the sleeve 102 to connect the slider 104 and the sleeve 102. The assembly pin 124 retains the sleeve 102 to the slider 104 when in either of the first and second configurations.

The assembly pin 124 is housed within an assembly bore and extends through the slider 104 transversely to the longitudinal axis L. The assembly pin 124 can be slid in the assembly bore and is maintained in the assembly bore, i.e., the assembly pin 124 cannot be easily removed from the slider 104. Specifically, a plunger 126 extends into the slider 104 to slidably retain the pin to the slider 104. The assembly pin 124 defines a channel and the plunger 126 includes a tip that slides within the channel as the assembly pin 124 is moved relative to the slider 104. The ends of the channel are closed such that as the assembly pin 124 is slid to the end of the channel, the tip abuts the end of the channel and retains the assembly pin 124 in the slider 104. It should be appreciated that the plunger 126 can be assembled to the slider 104 in any fashion, such as threaded engagement, adhesive engagement, pinned engagement, etc., without departing from the nature of the subject invention.

Referring to FIG. 9 and using directions relative to that Figure for exemplary purposes, to change the configuration of the handle assembly 92, the assembly pin 124 is slid to the left until it is slid entirely through the sleeve 102. As such, the sleeve 102 is freed from the slider 104. The slider 104 and the arm 110 are removed from the first slot 66 of the hand guard 52 as a unit. The slider 104 is flipped over and inserted into the second slot 68 such that the sleeve 102 abuts the second slot surface 122. The assembly pin 124 is then slid back into engagement with the sleeve 102 to connect the sleeve 102 to the slider 104.

As shown in FIGS. 2-4, the elongated member 96 extends from the body 94 toward the bolt carrier 82 substantially parallel to the longitudinal axis L. More specifically, the elongated member 96 extends along the handle axis H from between a first end 128 and a second end 130. As shown in FIGS. 8 and 9, the elongated member 96 is at least partially disposed within and fixedly secured to the body bore 98 for engaging and moving the bolt carrier 82 from the firing position to the rearward position as the handle assembly 92 moves from the forward position to the charging position. More specifically, the first end 128 of the elongated member 96 extends through the second opening 108 of the sleeve 102 into the body bore 98 and is disposed flush with sleeve 102 at the first opening 106 of the sleeve 102, as shown in FIG. 9. The second end 130 of the elongated member 96 is spaced from the second opening 108 of the sleeve 102. Typically, the elongated member 96 has a press-fit engagement with the sleeve 102 in the body bore 98. Said differently, the elongated member 96 is frictionally fixed to the slider 104 within the body bore 98. It is to be appreciated that the elongated member 96 and the sleeve 102 can be connected together in any fashion, such as welding, bolting, pinning, etc., without departing from the nature of the subject invention. Furthermore, it is to be appreciated that the first end 128 of the elongated member 96 can be disposed proximate adjacent to the second opening 108 of the body bore 98 or anywhere between the first and second openings 106, 108 without escaping the scope of the subject invention.

As shown in FIGS. 11 and 12, the elongated member 96 is disposed about the gas tube 72. The elongated member 96 entirely surrounds and extends along a portion of the gas tube 72 toward the bolt carrier 82 for engaging and moving the bolt carrier 82 from the firing position to the rearward position. As shown in FIGS. 2-4, the portion of the gas tube 72 refers to where the gas tube 72 is surrounded by the elongated member 96. More specifically, the gas tube 72 is typically longer than the elongated member 96 such that the portion of the gas tube 72 moves as the elongated member 96 moves along the gas tube 72.

As shown in FIGS. 11 and 12, the elongated member 96 defines a tubular bore 132 substantially parallel to the longitudinal axis L with the gas tube 72 disposed within the tubular bore 132 and the handle assembly 92 movable along the gas tube 72 between the forward and charging positions. More specifically, each of the gas tube 72 and the elongated member 96 has a tubular configuration with the gas tube 72 disposed within the tubular bore 132 of the elongated member 96. Each of the gas tube 72 and the elongated member 96 have a substantially linear configuration to facilitate movement of the handle assembly 92 along the gas tube 72 between the forward and charging positions. The linear configuration of each of the gas tube 72 and the elongated member 96 ensure that the gas tube 72 and the elongated member 96 don't bind against each other as the elongated member 96 moves between the forward and charging positions.

As generally shown in FIGS. 1 and 2, the handle assembly 92 is slidably coupled to the hand guard 52 to retain the handle assembly 92 at least partially within the hand guard 52 and to facilitate movement of the handle assembly 92 between the forward position and the charging position. As set forth above, the hand guard 52 defines the first support 58 and the second support 60 with the first support 58 further defined as the bushing 62 and the second support 60 further defined as at least one of the first and second slots 66, 68. The body 94 of the handle assembly 92 is slidably coupled to the first support 58 and the elongated member 96 is slidably coupled to the second support 60 to rotationally retain the handle assembly 92 relative to the longitudinal axis L and to facilitate movement of the handle assembly 92 between the forward position and the charging position. Specifically, as shown in FIGS. 2-4, the elongated member 96 extends through and is slidably coupled to the bushing 62. Furthermore, as set forth above, the hand guard 52 defines the first and second slots 66, 68 extending substantially parallel to the longitudinal axis L. As generally illustrated in FIG. 1, at least one of the sleeve 102 and the slider 104 of the base 100 extend through at least one of the first and second slots 66, 68 and slidably couples the body 94 to hand guard 52. The slidable coupling of the elongated member 96 with the bushing 62 and the slidable coupling of the base 100 of the body 94 with at least one of the first and second slots 66, 68 prevents rotation of the handle assembly 92 relative to the longitudinal axis L.

As set forth above, the elongated member 96 moves relative to the gas tube 72 between the forward and charging positions. The elongated member 96 engages the bolt carrier 82 to move the bolt carrier 82 from the firing position, as shown in FIG. 2, to the rearward position, as shown in FIG. 4, when the handle assembly 92 moves from the forward position to the charging position. More specifically, the key 84 of the bolt carrier 82 extends toward the elongated member 96. The elongated member 96 engages the key 84 to move the bolt carrier 82 from the firing position to the rearward position as the handle assembly 92 moves from the forward position to the charging position. Specifically, the elongated member 96 has a first surface 134 transverse to the longitudinal axis L and the key 84 has a second surface 136 transverse to the longitudinal axis L. The first surface 134 is disposed at the second end 130 of the elongated member 96. The first surface 134 abuts the second surface 136 when the elongated member 96 engages the key 84. Typically, the first surface 134 of the elongated member 96 abuts the second surface 136 of the key 84 when the handle assembly 92 is in the forward position. However, it is to be appreciated that the first surface 134 can be spaced from the second surface 136 when the handle assembly 92 is in the forward position.

As shown in FIG. 2, the first surface 134 of the elongated member 96 is substantially parallel to the second surface 136 of the key 84 to facilitate the abutment of the first surface 134 with the second surface 136 when the elongated member 96 engages the key 84. Typically, each of the first and second surfaces 134, 136 has an annular configuration, as generally illustrated by the elongated member 96 in FIG. 5, with first and second surfaces 134, 136 abutting each other along entirely along the annular configuration. It is to be appreciated that the first and second surfaces 134, 136 can have corresponding features which engage one another to further establish proper location of the first and second surfaces 134, 136. Furthermore, it is to be appreciated that the elongated member 96 and the bolt carrier 82 can have any configuration for engaging the elongated member 96 with the bolt carrier 82 without escaping the scope of the subject invention.

The operation of the firing the firearm 20 will be discussed below for illustrative purposes only. With the bolt carrier 82 in the firing position, as shown in FIG. 2, the trigger 36 is pulled by the operator releasing the hammer, which strikes the firing pin 90. The firing pin 90 strikes the live round of ammunition 22 to fire the ammunition 22, which causes the bullet to move through and out of the barrel bore 44. After firing the live round of ammunition 22, the exhaust gases are routed through the port, port tube 80, regulator 78, and gas tube 72 back to the bolt carrier 82, as described above. The exhaust gases enter the key 84 of the bolt carrier 82 and are then routed through the bolt carrier 82 and out the exhaust ports 86. The force of the exhaust gases pushes the bolt carrier 82 toward the rearward position, as shown in FIG. 3. During the movement of the bolt carrier 82, the key 84 separates from the gas tube 72. With the arm 110 of the body 94 of the handle assembly 92 in the disengaged position, the projection 118 of the arm 110 is nested in the notch 116 of the hand guard 52 which maintains the handle assembly 92 in the forward position, as shown in FIG. 1. The movement of the bolt carrier 82 from the firing position to rearward position spaces the bolt carrier 82 from the elongated member 96, as shown in FIG. 3. As the bolt carrier 82 moves toward the rearward position, the casing of the ammunition 22, which is now empty, is expelled from the receiver 24 through the ejection port 28. The bolt carrier 82 then automatically returns to the firing position and automatically loads another live round of ammunition 22 from the magazine 34 into the chamber, as shown in FIG. 2.

The operation of the firearm 20 as the handle assembly 92 moves from the forward position to the charging position will be discussed below for illustrative purposes only. To begin, the bolt carrier 82 is disposed in the firing position and the handle assembly 92 is in the forward position, as shown in FIG. 2. When the user desires to remove the live or spent ammunition 22, or any individual or combination of the components of the ammunition 22 described above, the user pivots the arm 110 of the body 94 of the handle assembly 92 from the disengaged position, as shown in FIG. 11, to the engaged position, as shown in FIG. 12. The projection 118 of the arm 110 is removed from the notch 116 of the hand guard 52 allowing the handle assembly 92 to translate along the handle axis H. The user moves the handle assembly 92 from the forward position toward the charging position, as shown in FIG. 4. The elongated member 96 moves along the gas tube 72 disposed within the tubular bore 132. The first surface 134 of the elongated member 96 engages the second surface 136 of the key 84 of the bolt carrier 82. Engagement of the elongated member 96 with key 84 of the bolt carrier 82 moves the bolt carrier 82 from the firing position to the rearward position while the handle assembly 92 moves from the forward position to the charging position. As the bolt carrier 82 moves toward the rearward position, the ammunition 22 is expelled from the receiver 24 through the ejection port 28. The user releases the arm 110 of the body 94 of the handle assembly 92. The bolt carrier 82 automatically returns from the rearward position to the firing position, as shown in FIG. 2, and automatically loads another live round of ammunition 22 from the magazine 34 into the chamber. The key 84 of the bolt carrier 82 engages the elongated member 96 and moves the handle assembly 92 from the charging position to forward position as the bolt carrier 82 moves from the rearward position to the firing position.

The firearm 20 described herein is designed to permit easy retro-fitting of the components to a variety of currently and/or previously manufactured firearm 20 designs including direct gas impingement systems and indirect gas impingement systems. For example, the firearm 20 components described herein may be retro-fitted to the M16, the M4®, such as the M4® carbine and the AR-15®, such as the AR-15® Platform. It is to be appreciated that there are several different manufacturers producing firearms 20 having similar components, appearance and operation to the M16, the M4® and the AR-15®; therefore, the firearm 20 described herein is applicable to firearms 20 outside the M16, M4® and AR-15® designs.

The handle assembly 92 is designed to permit easy retro-fitting of existing firearms 20. For example, the firearm 20 shown in FIG. 1 includes a version of a standard charging handle 138 and a version of a standard forward assist mechanism 140. The firearm 20 is retro-fitted with the handle assembly 92, which can be used to perform the function of the standard charging handle 138. The handle assembly 92 is duplicative of the standard charging handle 138 but provides the advantages described above. As such, existing firearms 20 can merely be retro-fitted with the handle assembly 92 to gain the advantages of the handle assembly 92 without the need of producing new firearms 20. The firearm 20 can also be produced without the standard charging handle 138.

The invention has been described in an illustrative manner, and it is to be understood that the terminology which has been used is intended to be in the nature of words of description rather than of limitation. As is now apparent to those skilled in the art, many modifications and variations of the subject invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A firearm comprising:

a receiver defining a receiver bore extending along a longitudinal axis;

a bolt carrier disposed in said receiver bore and moveable relative to said receiver along said longitudinal axis between a firing position and a rearward position;

a hand guard coupled to said receiver;

a gas tube disposed at least partially within and fixed relative to said hand guard and extending substantially parallel to said longitudinal axis; and a handle assembly at least partially disposed in said hand guard and moveable between a forward position and a charging position with said handle assembly having a body and an elongated member extending from said body toward said bolt carrier substantially parallel to said longitudinal axis with said elongated member disposed about said gas tube and movable relative to said gas tube between said forward and charging positions with said elongated member engaging said bolt carrier to move said bolt carrier from said firing position to said rearward position when said handle assembly moves from said forward position to said charging position;

wherein said elongated member defines a bore substantially parallel to said longitudinal axis with said gas tube disposed within said bore and said handle assembly movable along said gas tube between said forward and charging positions.

2. A firearm as set forth in claim 1 wherein said elongated member entirely surrounds and extends along a portion of said gas tube toward said bolt carrier for engaging and moving said bolt carrier from said firing position to said rearward position.

3. A firearm as set forth in claim 1 wherein each of said gas tube and said elongated member have a substantially linear configuration to facilitate movement of said handle assembly along said gas tube between said forward and charging positions.

4. A firearm as set forth in claim 1 wherein said bolt carrier has a key extending toward said handle assembly with said elongated member engaging said key to move said bolt carrier from said firing position to said rearward position as said handle assembly moves from said forward position to said charging position.

5. A firearm as set forth in claim 4 wherein said elongated member has a first surface transverse to said longitudinal axis and said key has a second surface transverse to said longitudinal axis and with said first surface abutting said second surface when said elongated member engages said key.

6. A firearm as set forth in claim 5 wherein said first surface of said elongated member is substantially parallel to said second surface of said key to facilitate said abutment of said first surface with said second surface when said elongated member engages said key.

7. A firearm as set forth in claim 1 wherein said body defines a body bore substantially parallel to said longitudinal axis with said elongated member at least partially disposed within and fixedly secured to said body bore.

8. A charging mechanism for a firearm, said charging mechanism comprising:

a bolt carrier extending along a longitudinal axis;

a gas tube extending substantially parallel to said longitudinal axis; and a handle assembly having a body and an elongated member extending from said body toward said bolt carrier substantially parallel to said longitudinal axis with said elongated member disposed about said gas tube and movable relative to said gas tube between a forward position and a charging position, said elongated member engaging and moving said bolt carrier from a firing position to a rearward position as said handle assembly moves from said forward position to said charging position;

wherein said elongated member defines a hole substantially parallel to said longitudinal axis with said gas tube disposed within said hole and said handle assembly movable along said gas tube between said forward and charging positions.

9. A charging mechanism as set forth in claim 8 wherein said elongated member surrounds and extends along said gas tube toward said bolt carrier for engaging and moving said bolt carrier from said firing position to said rearward position.

10. A charging mechanism as set forth in claim 8 wherein each of said gas tube and said elongated member have a substantially linear configuration to facilitate movement of said handle assembly along said gas tube between said forward and charging positions.

11. A charging mechanism as set forth in claim 8 wherein said bolt carrier has a key extending toward said handle assembly with said elongated member engaging said key to move said bolt carrier from said firing position to said rearward position as said handle assembly moves from said forward position to said charging position.

12. A charging mechanism as set forth in claim 11 wherein said elongated member has a first surface transverse to said longitudinal axis and said key has a second surface transverse to said longitudinal axis and with said first surface abutting said second surface when said elongated member engages said key.

13. A charging mechanism as set forth in claim 12 wherein said first surface of said elongated member is substantially parallel to said second surface of said key to facilitate said abutment of said first surface with said second surface when said elongated member engages said key.

14. A charging mechanism as set forth in claim 8 wherein said body defines a body bore substantially parallel to said longitudinal axis with said elongated member at least partially disposed within and fixedly secured to said body bore.

15. A firearm comprising:

a receiver defining a receiver bore extending along a longitudinal axis;

a bolt carrier disposed in said receiver bore and moveable relative to said receiver along said longitudinal axis between a firing position and a rearward position;

a hand guard coupled to said receiver;

a gas tube disposed at least partially within and fixed relative to said hand guard and extending substantially parallel to said longitudinal axis; and a handle assembly at least partially disposed in said hand guard and moveable between a forward position and a charging position with said handle assembly having a body and an elongated member extending from said body toward said bolt carrier substantially parallel to said longitudinal axis with said elongated member disposed about said gas tube and movable relative to said gas tube between said forward and charging positions with said elongated member engaging said bolt carrier to move said bolt carrier from said firing position to said rearward position when said handle assembly moves from said forward position to said charging position;

wherein said bolt carrier has a key extending toward said handle assembly with said elongated member engaging said key to move said bolt carrier from said firing position to said rearward position as said handle assembly moves from said forward position to said charging position; and wherein said gas tube is at least partially disposed within said key when said bolt carrier is in said firing position and said gas tube is spaced from said key when said bolt carrier is in said rearward position with said gas tube fluidly coupled to said key in said firing position.

16. A firearm as set forth in claim 15 wherein said elongated member has a first surface transverse to said longitudinal axis and said key has a second surface transverse to said longitudinal axis and with said first surface abutting said second surface when said elongated member engages said key.

17. A firearm as set forth in claim 16 wherein said first surface of said elongated member is substantially parallel to said second surface of said key to facilitate said abutment of said first surface with said second surface when said elongated member engages said key.

18. A firearm comprising:

a receiver defining a receiver bore extending along a longitudinal axis;

a bolt carrier disposed in said receiver bore and moveable relative to said receiver along said longitudinal axis between a firing position and a rearward position;

a hand guard coupled to said receiver;

a gas tube disposed at least partially within and fixed relative to said hand guard and extending substantially parallel to said longitudinal axis; and a handle assembly at least partially disposed in said hand guard and moveable between a forward position and a charging position with said handle assembly having a body and an elongated member extending from said body toward said bolt carrier substantially parallel to said longitudinal axis with said elongated member disposed about said gas tube and movable relative to said gas tube between said forward and charging positions with said elongated member engaging said bolt carrier to move said bolt carrier from said firing position to said rearward position when said handle assembly moves from said forward position to said charging position;

wherein said handle assembly is slidably coupled to said hand guard to retain said handle assembly at least partially within said hand guard and to facilitate movement of said handle assembly between said forward position and said charging position; and wherein said hand guard defines a first support and a second support with said body of said handle assembly slidably coupled to said first support and said elongated member slidably coupled to said second support to rotationally retain said handle assembly relative to said longitudinal axis and to facilitate movement of said handle assembly between said forward position and said charging position.

19. A firearm as set forth in claim 18 wherein said elongated member entirely surrounds and extends along a portion of said gas tube toward said bolt carrier for engaging and moving said bolt carrier from said firing position to said rearward position.

20. A firearm as set forth in claim 18 wherein said elongated member defines a tubular bore substantially parallel to said longitudinal axis with said gas tube disposed within said tubular bore and said handle assembly movable along said gas tube between said forward and charging positions.

21. A charging mechanism for a firearm, said charging mechanism comprising:

a bolt carrier extending along a longitudinal axis;

a gas tube extending substantially parallel to said longitudinal axis; and a handle assembly having a body and an elongated member extending from said body toward said bolt carrier substantially parallel to said longitudinal axis with said elongated member disposed about said gas tube and movable relative to said gas tube between a forward position and a charging position, said elongated member engaging and moving said bolt carrier from a firing position to a rearward position as said handle assembly moves from said forward position to said charging position;

wherein said bolt carrier has a key extending toward said handle assembly with said elongated member engaging said key to move said bolt carrier from said firing position to said rearward position as said handle assembly moves from said forward position to said charging position; and wherein said gas tube is at least partially disposed within said key when said bolt carrier is in said firing position and said gas tube is spaced from said key when said bolt carrier is in said rearward position with said gas tube fluidly coupled to said key in said firing position.

* * * * *